US011380975B2

(12) United States Patent
Verlinden et al.

(10) Patent No.: US 11,380,975 B2
(45) Date of Patent: Jul. 5, 2022

(54) OVERBOARD TRACKING DEVICE

(71) Applicant: Pallas LLC, Clarksburg, MD (US)

(72) Inventors: Christopher Verlinden, Clarksburg, MD (US); Jacquelyn S. Kubicko, Clarksburg, MD (US)

(73) Assignee: PALLAS LLC, Clarksburg, MD (US)

( * ) Notice: Subject to any disclaimer, the term of this patent is extended or adjusted under 35 U.S.C. 154(b) by 365 days.

(21) Appl. No.: 16/734,076

(22) Filed: Jan. 3, 2020

(65) Prior Publication Data

US 2020/0216153 A1 Jul. 9, 2020

Related U.S. Application Data

(60) Provisional application No. 62/788,080, filed on Jan. 3, 2019.

(51) Int. Cl.

| | |
|---|---|
| ***B63C 9/20*** | (2006.01) |
| ***H01Q 1/22*** | (2006.01) |
| ***H01Q 1/24*** | (2006.01) |
| ***H01Q 9/04*** | (2006.01) |
| ***B63C 9/00*** | (2006.01) |

(Continued)

(52) U.S. Cl.

CPC ..... *H01Q 1/2225* (2013.01); *B63C 9/0005* (2013.01); *B63C 9/20* (2013.01); *H01Q 1/24* (2013.01); *H01Q 9/0407* (2013.01); *B63B 2201/12* (2013.01); *B63B 2201/20* (2013.01); *B63C 9/082* (2013.01); *B63C 9/11* (2013.01); *B63C 9/13* (2013.01); *B63C 2009/0017* (2013.01)

(58) Field of Classification Search

CPC ..... H01Q 1/2225; H01Q 1/24; H01Q 9/0407; B63C 9/0005; B63C 9/20; B63C 9/082; B63C 9/11; B63C 9/13; B63C 2009/0017; B63B 2201/12; B63B 2201/20

See application file for complete search history.

(56) References Cited

U.S. PATENT DOCUMENTS 7,854,639 B1 12/2010 Leal et al.
8,998,666 B1 * 4/2015 Albright ..... B63C 9/00 340/573.6

(Continued)

FOREIGN PATENT DOCUMENTS

EP 3330910 A1 6/2018

*Primary Examiner* — Stephen P Avila

(57) ABSTRACT

An overboard tracking device is an apparatus which facilitates the location of individuals wearing Personal Flotation Devices (PFDs) or similar survival devices in a body of water. The apparatus includes a prismatic buoyant housing, a power source, at least one switch, a controller, a transceiver, a thermionic layer, an antenna layer, and a waterproof casing. The prismatic buoyant housing maintains the apparatus above water. The power source provides power for the operation of the apparatus. The at least one switch enables manual or automatic activation or deactivation for the apparatus. The controller processes the data and signals received from external radar sources. The transceiver facilitates the sending and receiving of radio wave signals to/from external radar sources. The thermionic layer generates the power stored in the power source. The antenna layer transmits radio waves from/to the transceiver. The waterproof casing prevents contact of the electronic components with water.

16 Claims, 12 Drawing Sheets

(51) Int. Cl.

| | |
|---|---|
| *B63C 9/08* | (2006.01) |
| *B63C 9/11* | (2006.01) |
| *B63C 9/13* | (2006.01) |

(56) References Cited

U.S. PATENT DOCUMENTS

| | | | | |
|---|---|---|---|---|
| 9,536,215 | B2 | 1/2017 | Rehman | |
| 10,482,361 | B2 | 11/2019 | Yanson et al. | |
| 2002/0097157 | A1* | 7/2002 | Piri | B63C 9/0005 340/539.1 |
| 2008/0178790 | A1* | 7/2008 | Hatfield | G08B 5/002 116/209 |
| 2009/0058658 | A1* | 3/2009 | Kai | H01Q 9/045 340/572.7 |
| 2011/0109442 | A1 | 5/2011 | Pavlov et al. | |
| 2016/0152350 | A1 | 6/2016 | Puentes et al. | |

* cited by examiner

OVERBOARD TRACKING DEVICE

The current application claims a priority to the U.S. Provisional Patent application Ser. No. 62/788,080 filed on Jan. 3, 2019.

FIELD OF THE INVENTION

The present invention generally relates to systems and methods for long-range tracking and location. More specifically, the present invention provides an overboard tracking device to locate individuals who need assistance after falling overboard in bodies of water.

BACKGROUND OF THE INVENTION

Locating individuals once separated from a marine vessel in large bodies of water is perhaps one of the greatest challenges in maritime Search and Rescue (SAR). Personal Flotation Devices (PFDs) are generally required to be carried by marine vessels with equipment specifications often regulated by a Federal Government. Most PFDs make it possible for People in the Water (PIWs) to remain afloat for extended periods of time; however, PFDs do not significantly reduce the challenges associated with locating PIWs. For example, while many PFDs are designed to provide some visibility to facilitate the tracking of PIWs, the visibility provided by currently available PFDs is limited and oftentimes useless due to many variables, such as weather, poor illumination, etc. Nowadays, various location and tracking technologies have been provided. Many technologies such as Global Positioning Systems (GPS) have been provided to allow for remote tracking of people and objects. However, implementing these technologies on PFDs is often expensive and unpractical due to the large amounts of PFDs provided on marine vessels and the extensive maintenance some of these technologies require.

An objective of the present invention is to provide a simple, inexpensive overboard tracking device comprising a passive, long-range Radio Frequency Identification (RFID) antenna designed to transmit at various radio frequencies, either two to four Megahertz (MHz) (S-band) or eight to twelve MHz (X-band) when interrogated by a marine surface search radar meant to be attached to PFDs and Type IV throwable flotation devices. The present invention allows for easy detection of PIWs by standard marine radars. The overboard tracking device comprises an exterior preferably coated in a material which fluoresces extremely brightly in Infrared (IR) light, such as Trivalent Chromium ions encased in Zinc Gallogermanate. Coast Guard (CG) helicopters already equipped with Electro-Optical Sensor Systems (ESS), could easily detect the signature emitted by the overboard tracking device, adding to the already increased detection threshold for PIWs wearing PFDs. These PFDs additions would greatly improve the survivability of PIWs during the day and night. The present invention further makes inspections for flotation gear extremely quick and easy, as the flotation gear could be scanned while onboard vessels, from a distance, and maintenance, inspections, and expiration information for each device could be stored in a centralized database.

DETAILED DESCRIPTION OF THE INVENTION

Figure 1:
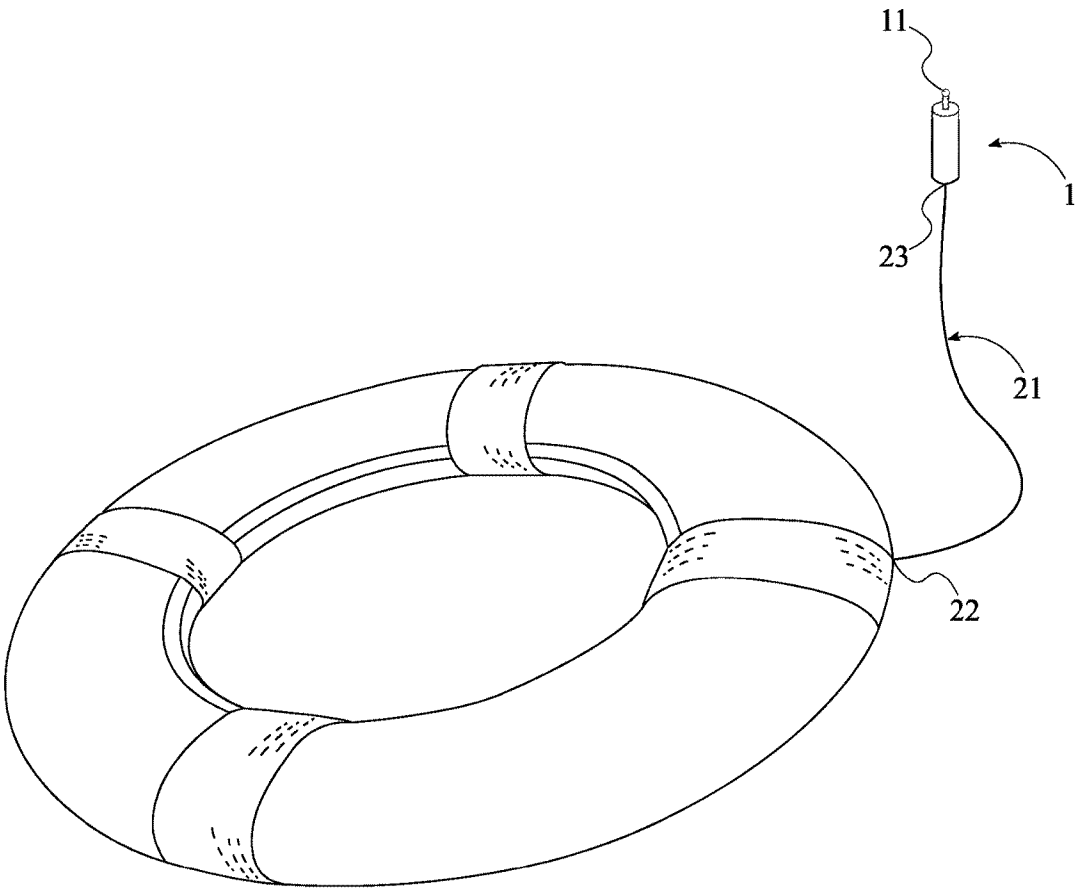
FIG. 1 is a top perspective view showing the overboard tracking device attached to a PFD by the tether.

All illustrations of the drawings are for the purpose of describing selected versions of the present invention and are not intended to limit the scope of the present invention.

The present invention provides an overboard tracking device. The overboard tracking device facilitates the location of individuals wearing Personal Flotation Devices (PFDs) or similar survival devices in a body of water. In a preferred embodiment, the present invention comprises a prismatic buoyant housing 1, a power source 2, at least one switch 3, a controller 4, a transceiver 5, a thermionic layer 6, an antenna layer 24, and a waterproof casing 7. The prismatic buoyant housing 1 maintains the present invention above water so the user can easily find the present invention. The power source 2 provides power for the operation of the present invention. The at least one switch 3 enables the user to activate or deactivate the present invention immediately to send a distress signal. The controller 4 processes the data and signals received from external radio sources to generate the distress signal. The transceiver 5 facilitates the sending and receiving of radio wave signals to/from external radio sources to transmit the distress signal. The thermionic layer 6 generates the power stored in the power source 2 by the thermal differential between the thermionic layer 6 and the external environment. The antenna layer 24 transmits radio waves from/to the transceiver 5 that contain the distress signals. The waterproof casing 7 prevents contact of the electronic components with the surroundings.

Figure 2:
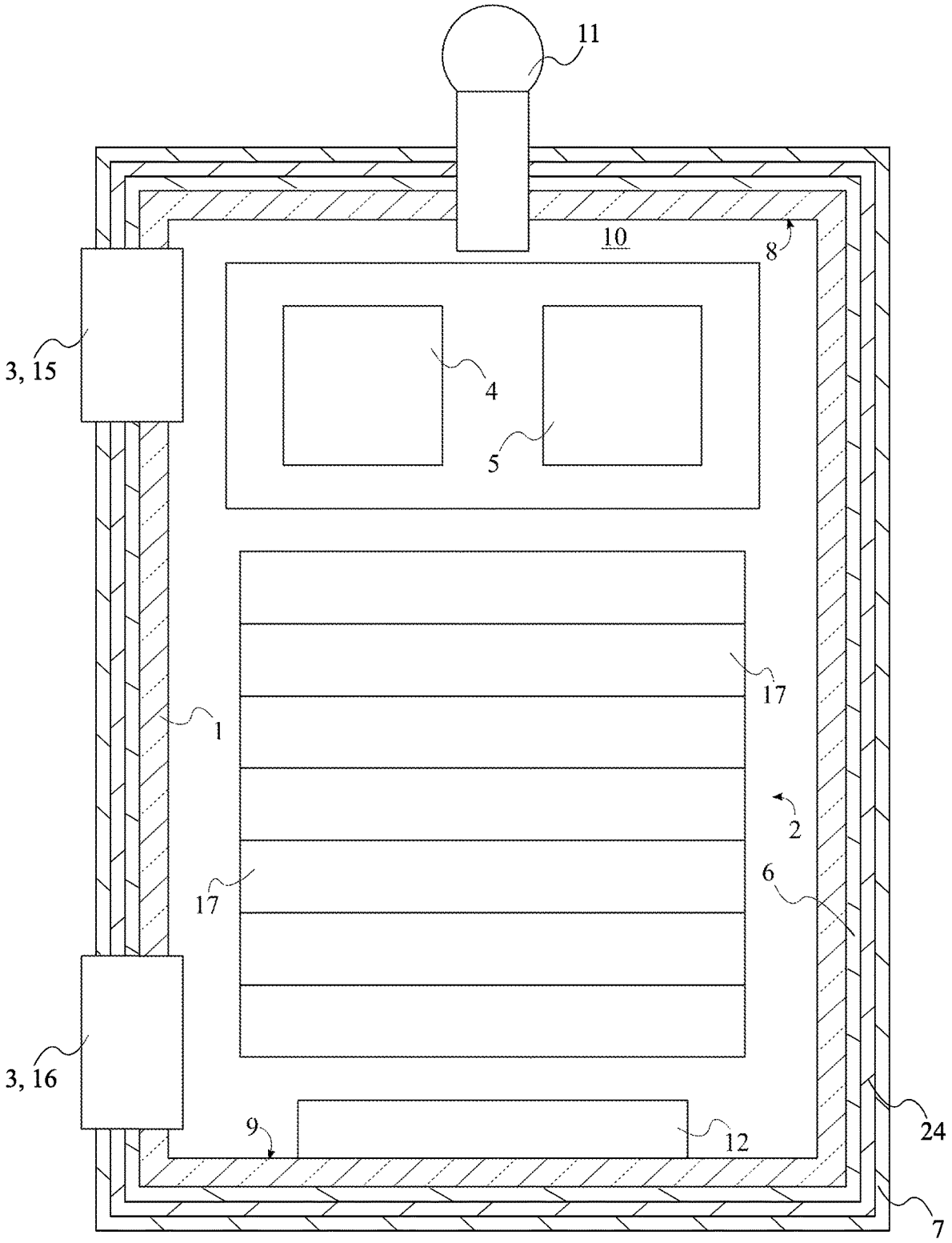
FIG. 2 is a schematic view showing the low-power configuration of the overboard tracking device without the tether.
Figure 3:
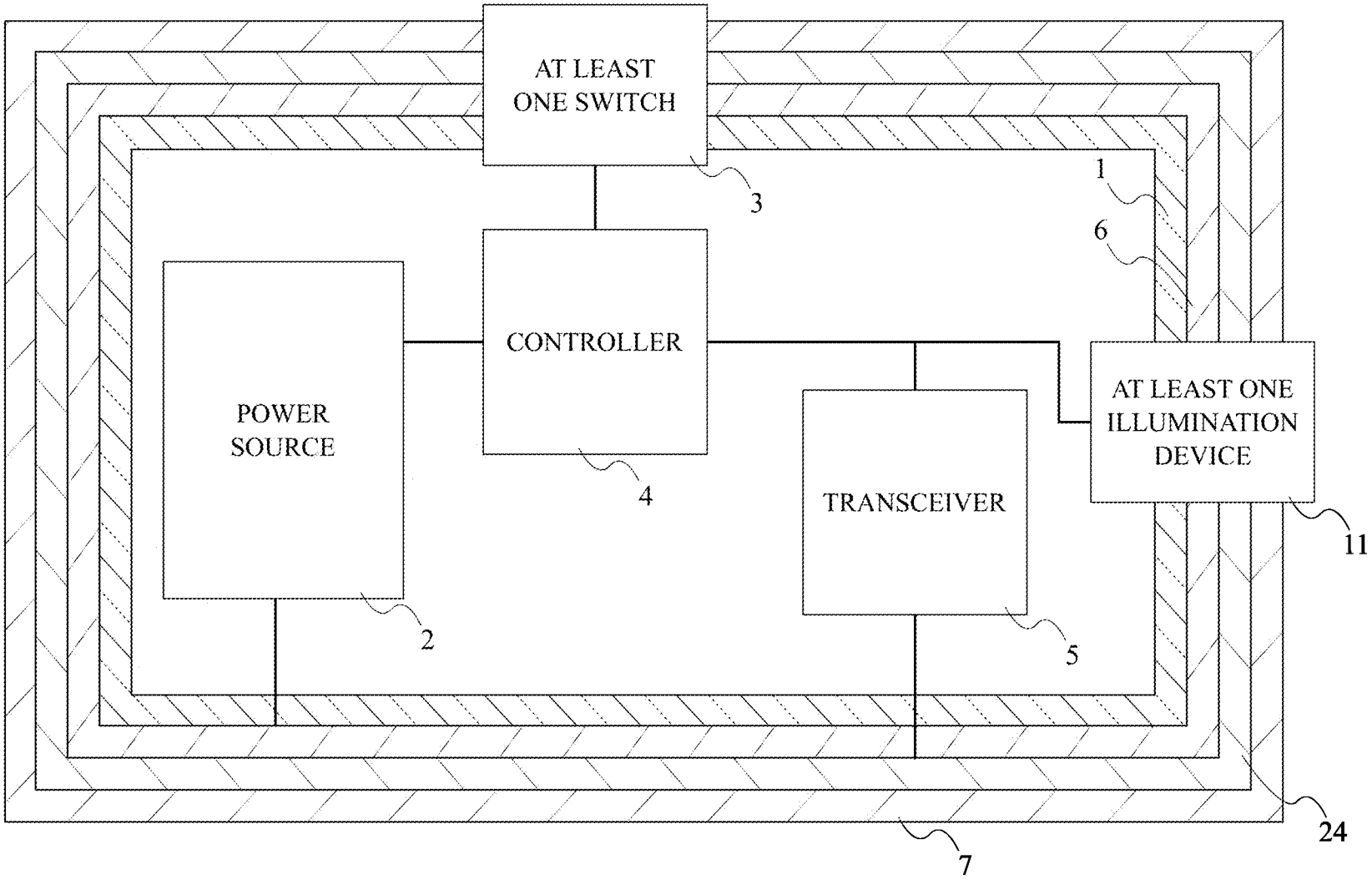
FIG. 3 is an electrical diagram showing the low-power configuration of the overboard tracking device.
Figure 6:
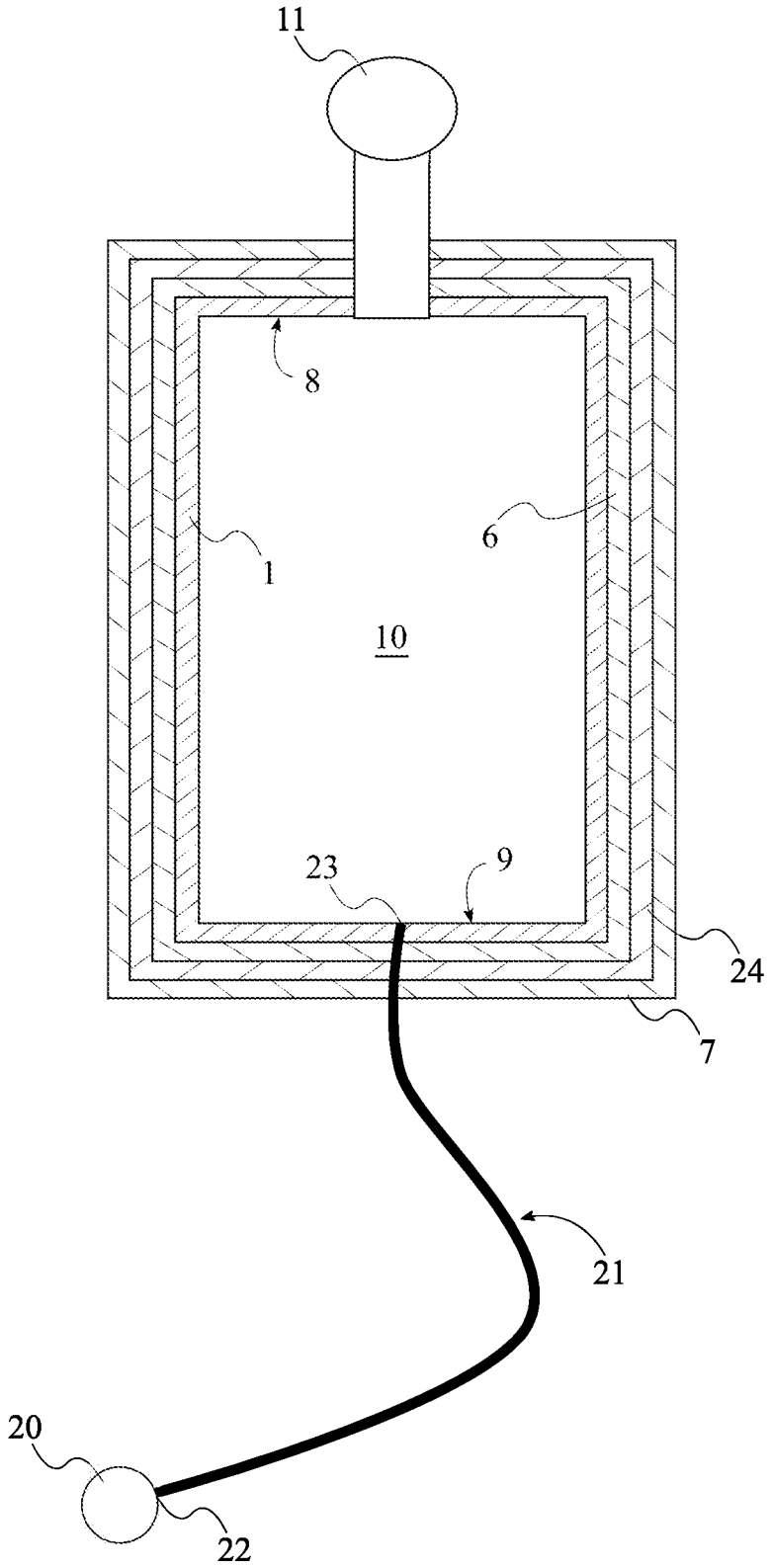
FIG. 6 is a schematic view showing the prismatic buoyant housing and the tether of the overboard tracking device.

The aforementioned components enable the present invention to facilitate the location of overboard individuals. As can be seen in FIGS. 1 and 6, the prismatic buoyant housing 1 comprises a first base portion 8, a second base portion 9, and a lateral portion 10 to form a closed structure. As can be seen in FIGS. 2 and 3, the power source 2, the controller 4, and the transceiver 5 are mounted within the prismatic buoyant housing 1 to maintain each component isolated from the external environment. The thermionic layer 6 is externally superimposed onto the prismatic buoyant housing 1 to facilitate the heat exchange between the thermionic layer 6 and surrounding bodies. The antenna layer 24 is superimposed onto the thermionic layer 6 to facilitate the transmission of radio waves. The waterproof casing 7 is superimposed onto the antenna layer 24 to protect the antenna layer 24 as well as the thermionic layer 6 from water damage. The at least one switch 3 is hermetically integrated through the waterproof casing 7, the antenna layer 24, and the thermionic layer 6 and into the lateral portion 10 for ease of access to the at least one switch 3 and to keep the present invention waterproof. The power source 2 is electrically connected to the controller 4 and the thermionic layer 6 to receive power from the thermionic layer 6 and to provide power to the controller 4. The controller 4 is electronically connected to the at least one switch 3 and the transceiver 5 so the user can selectively activate the controller 4 and the transceiver 5.

The present invention is provided in various configurations which utilize different location tracking methods. In a low-power configuration, the present invention may further comprise at least one illumination device 11 and a weight 12. As can be seen in FIGS. 2 and 3, the at least one illumination device 11 is hermetically integrated through the waterproof casing 7, the antenna layer 24, and the thermionic layer 6 and the into the first base portion 8 which allows the at least one illumination device 11 to be externally visible on the prismatic buoyant housing 1 while being operatively coupled with some of the internal components of the present invention through a water-sealed connection. The at least one illumination device 11 is also electronically connected to the controller 4. The at least one illumination device 11 is preferably a Near-Infrared (NIR) strobe light 14 which is activated by the controller 4 to emit an emergency signal. To orient the at least one illumination device 11 above water, the weight 12 is mounted within the prismatic buoyant housing 1, adjacent to the second base portion 9.

Figure 4:
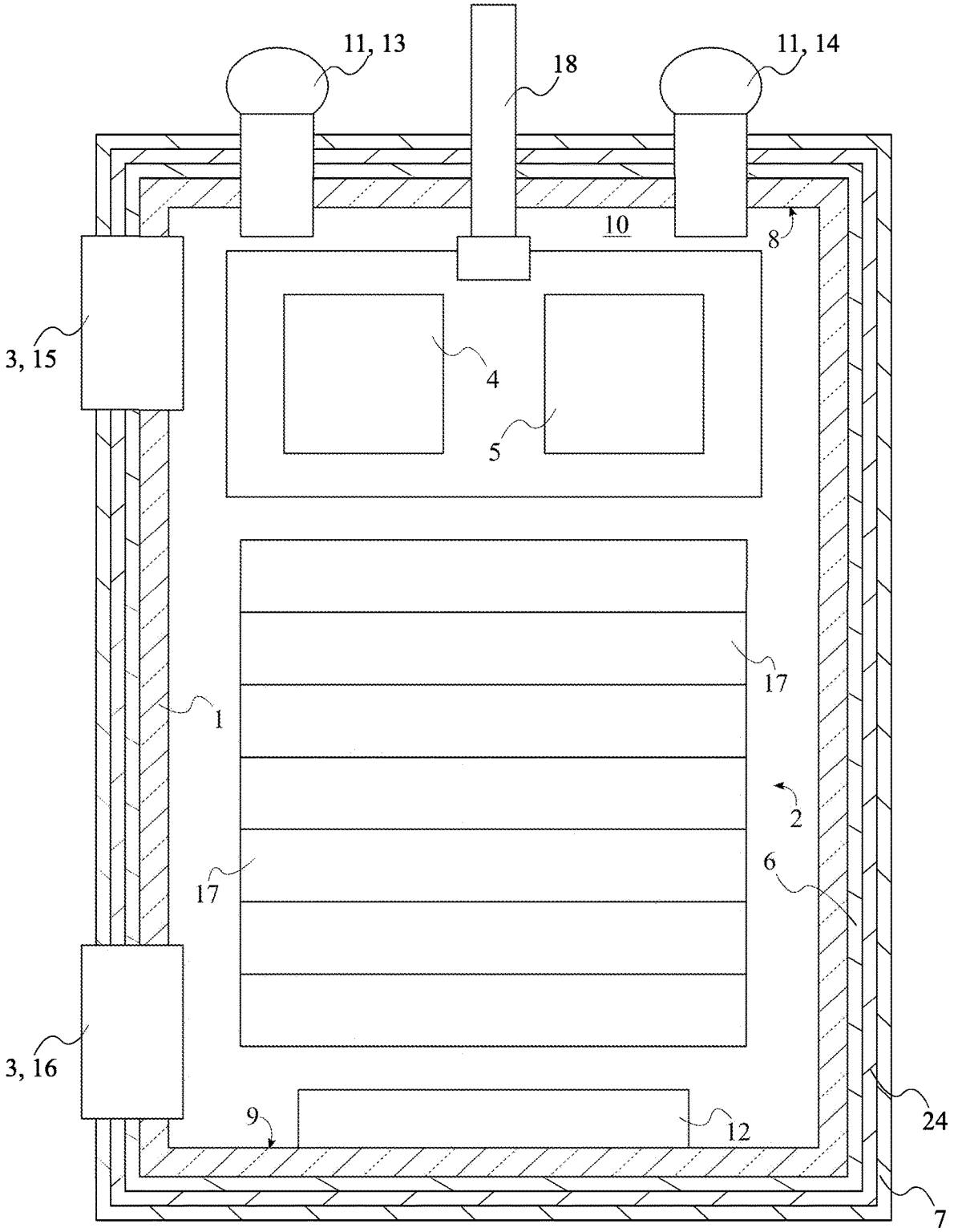
FIG. 4 is a schematic view showing the high-power configuration of the overboard tracking device without the tether.

In a high-power configuration, the present invention provides additional light sources to emit different light signals which can be visible in different light conditions. As can be seen in FIG. 4, the at least one illumination device 11 may comprise a Light Emitting Diode (LED) strobe light 13 and a NIR strobe light 14. The LED strobe light 13 identifies the visual location of the PFD in a body of water, and the NIR strobe light 14 identifies the location of the PFD using devices capable of detecting NIR light. The LED strobe light 13 and the NIR strobe light 14 are positioned offset from each other across the first base portion 8 to not obstruct with each other.

In both low-power and high-power configurations, the at least one switch 3 provides direct and indirect methods of activating the present invention. As can be seen in FIGS. 2 and 4, the at least on switch may comprise a manual switch 15 and a water-activated switch 16. The manual switch 15 enables the manual activation of the controller 4 and the transceiver 5. The manual switch 15 is positioned adjacent to the first base portion 8 to keep the manual switch 15 above the surface of the water in case the user goes overboard. In cases where the user cannot access the manual switch 15, the water-activated switch 16 automatically activates the controller 4 and the transceiver 5 once the prismatic buoyant housing 1 is in contact with the water of body. The water-activated switch 16 is positioned adjacent to the second base portion 9 so when the user falls overboard the water-activated switch 16 is positioned under the surface of the water.

While the present invention facilitates the visual location of a PFD, the present invention also facilitates the location of the PFD using search radars. The antenna layer 24 and the transceiver 5 can be configured to transmit over different bandwidths. The antenna layer 24 is configured to receive an RF frequency selected from the group consisting of 406 MHz, X-band, S-band, and combinations thereof. The antenna layer 24 is also configured to transmit an RF frequency selected from the group consisting of 406 MHz, X-band, S-band, and combinations thereof. In the low-power configuration, the antenna layer 24 can transmit in just the 406 MHz band, or in the range of 406 MHz, the X-band, and the S-band. In the high-power configuration, the antenna layer 24 can transmit on the 406 band, the X-band, and the S-band. The high-power configuration can further transmit using Very High Frequency (VHF) technology or Automated Identification Systems (AIS).

In both low-power and high-power configurations, the power source 2 provides the appropriate power for the operation of the present invention. As can be seen in FIGS. 2 and 4, the power source 2 may comprise a plurality of coin batteries 17. The type or capability of the plurality of coin batteries 17 depends on the power needs of the present invention. The plurality of coin batteries 17 is stacked upon each other to save space and connect each of the plurality of coin batteries 17 together. The plurality of coin batteries 17 is also positioned adjacent to the second base portion 9 to maintain the prismatic buoyant housing 1 in a vertical orientation while floating in a body of water.

Figure 5:
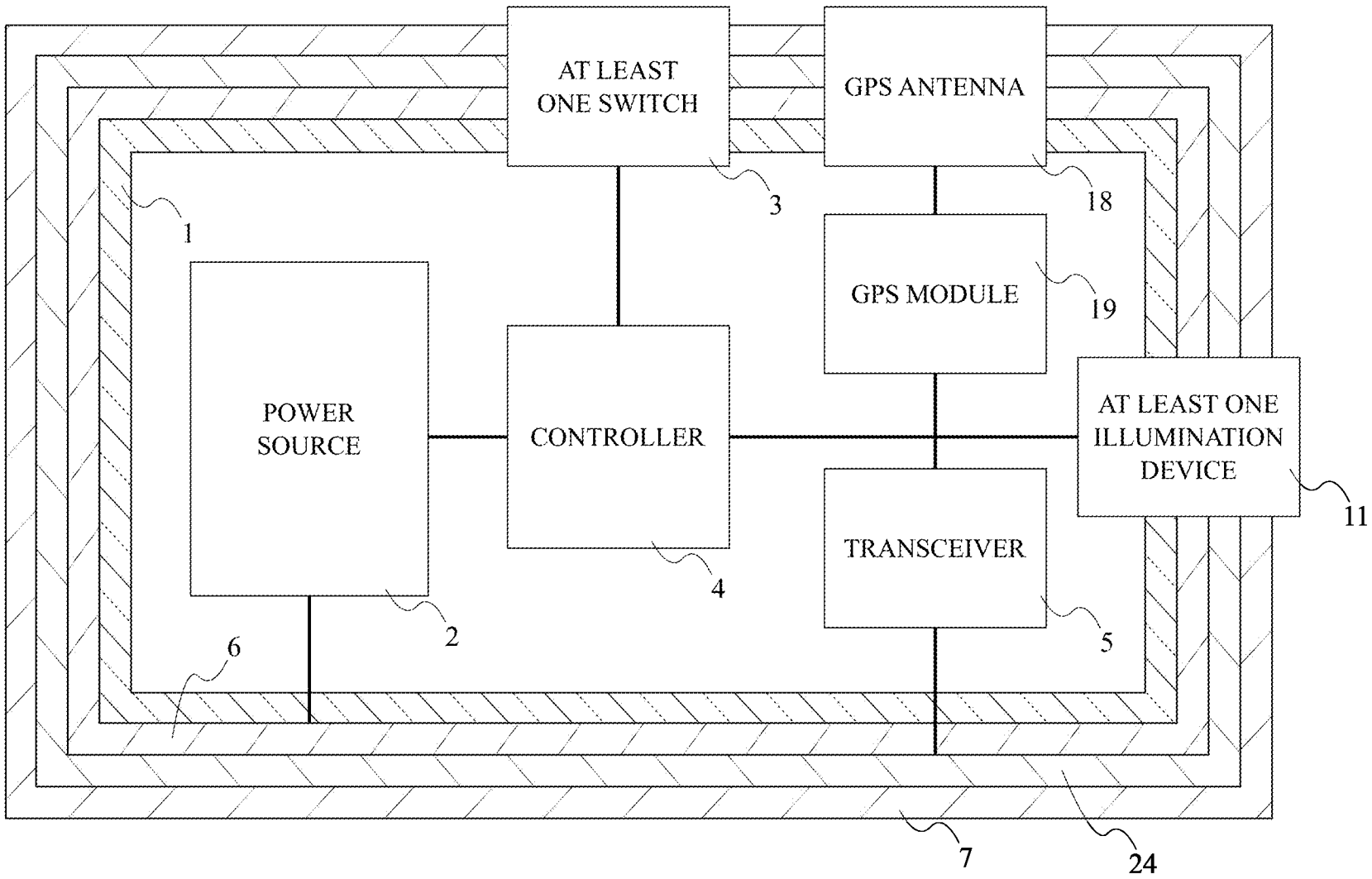
FIG. 5 is an electrical diagram showing the high-power configuration of the overboard tracking device.

In the high-power configuration, the present invention also provides long-range location tracking capabilities. As can be seen in FIGS. 4 and 5, the present invention may further comprise a Global Positioning System (GPS) antenna 18 and a GPS module 19. The GPS antenna 18 is hermetically integrated through the waterproof casing 7, the antenna layer 24, and the thermionic layer 6 and into the first base portion 8, which allows the GPS antenna 18 to be externally accessible on the prismatic buoyant housing 1 while being operatively coupled with the GPS module 19 through a water-sealed connection. The GPS module 19 is mounted within the prismatic buoyant housing 1. The controller 4 is electronically connected to the GPS module 19 to control the operations of the GPS module 19. The GPS module 19 is electronically connected to the GPS antenna 18 to transmit GPS data including the location of the PFD and the user.

Finally, to facilitate the attachment of the prismatic buoyant housing 1 to a PFD, the present invention further provides an anchoring mechanism 20 and a tether 21. As can be seen in FIGS. 1 and 6, the tether 21 and the anchoring mechanism 20 facilitate the secure attachment of the present invention to the PFD. The anchoring mechanism 20 enables the attachment of the present invention to the body of the PFD. Moreover, the tether 21 may comprise a first end 22 and a second end 23. The tether 21 has a length which keeps the present invention close to the PFD while enabling the operation of the present invention. The anchoring mechanism 20 is fixed to the first end 22 to prevent detachment of the tether 21 from the anchoring mechanism 20. The second end 23 is hermetically integrated through the waterproof casing 7, the antenna layer 24, and the thermionic layer 6 and into the second base portion 9, which allows the prismatic buoyant housing 1 to float in a vertical orientation in the water while being secured to the prismatic buoyant housing 1.

Figure 7:
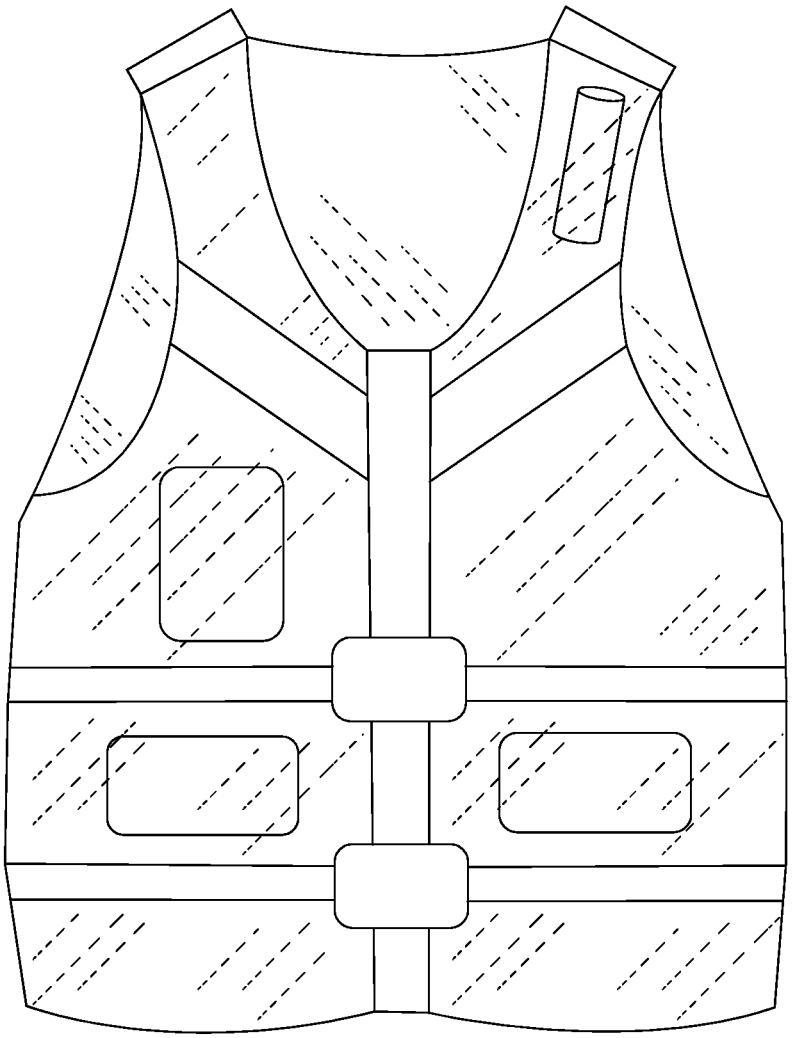
FIG. 7 is a front view showing the overboard tracking device integrated into a PFD vest.
Figure 8:
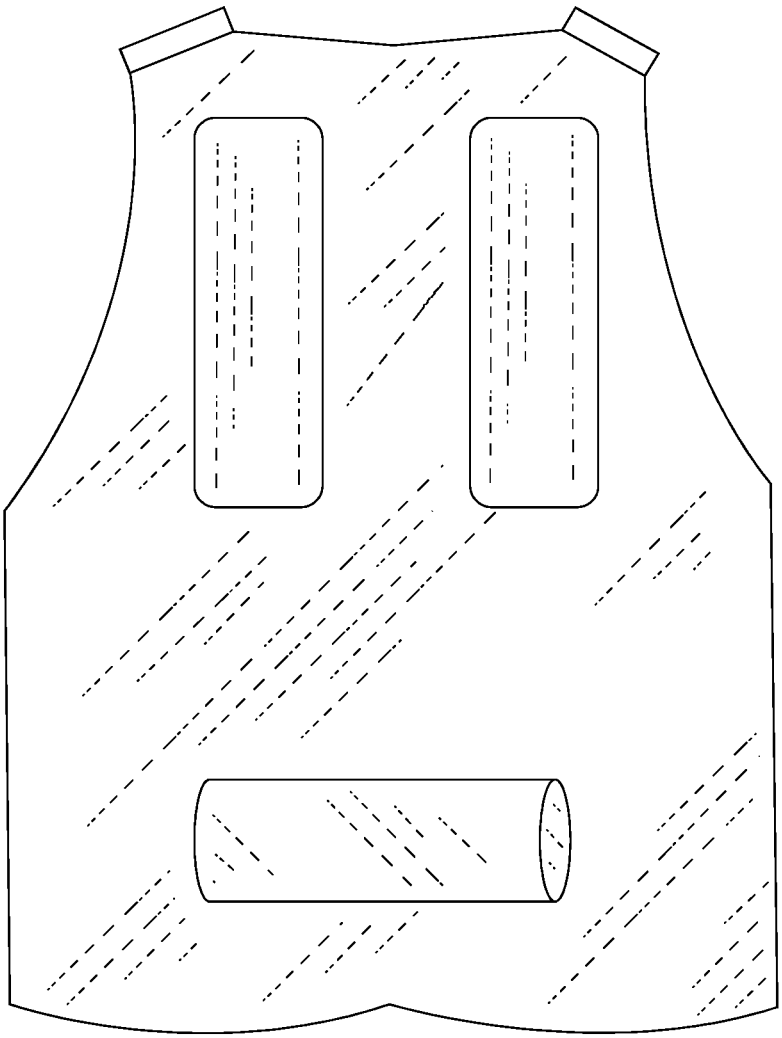
FIG. 8 is a back view showing the overboard tracking device integrated into a PFD vest.
Figure 9:
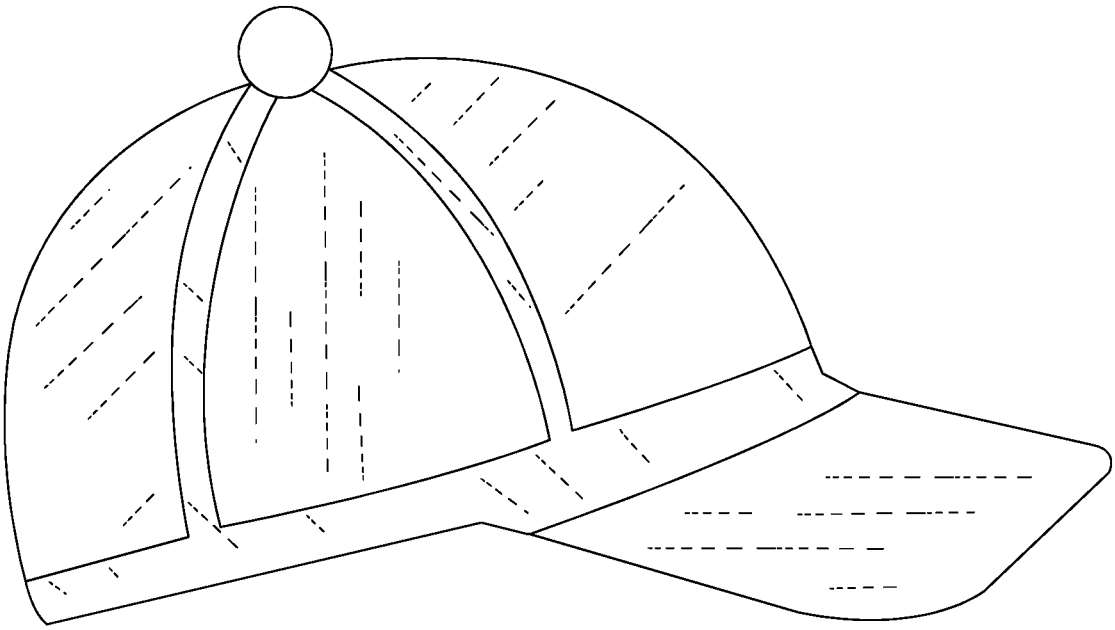
FIG. 9 is a side view showing the overboard tracking device integrated into a PFD headgear.
Figure 10:
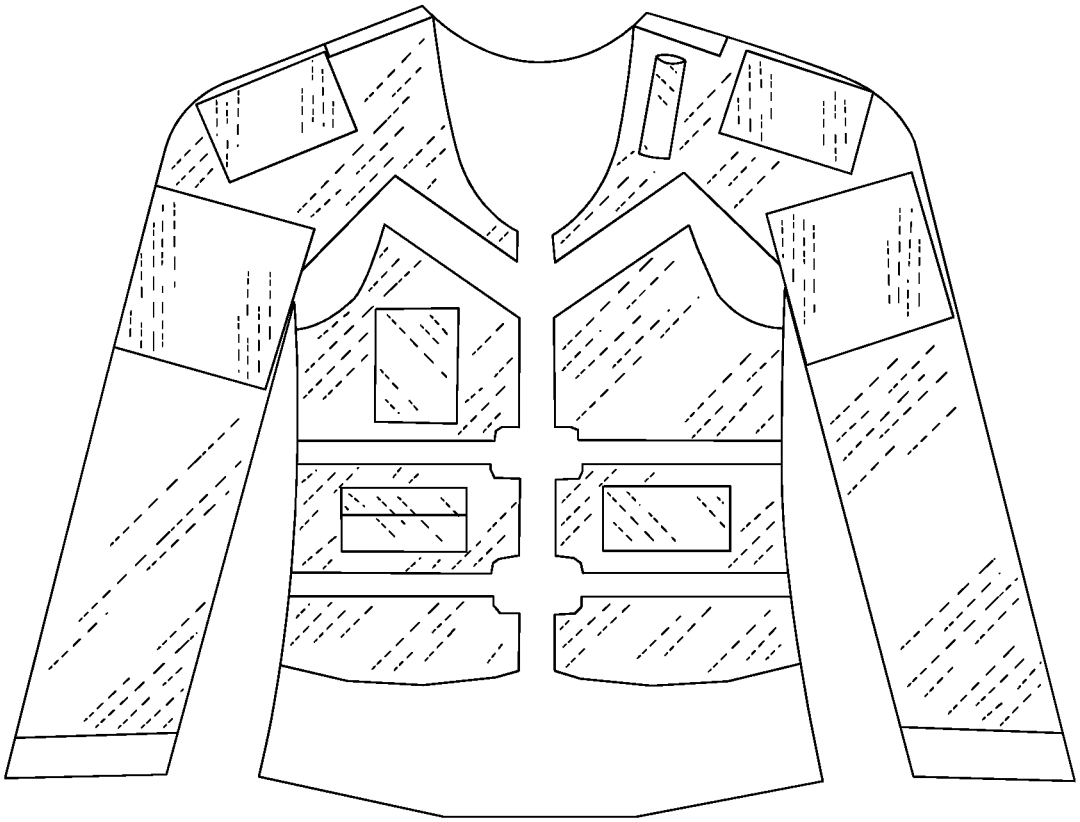
FIG. 10 is a front view showing the overboard tracking device integrated into a PFD jacket.
Figure 11:
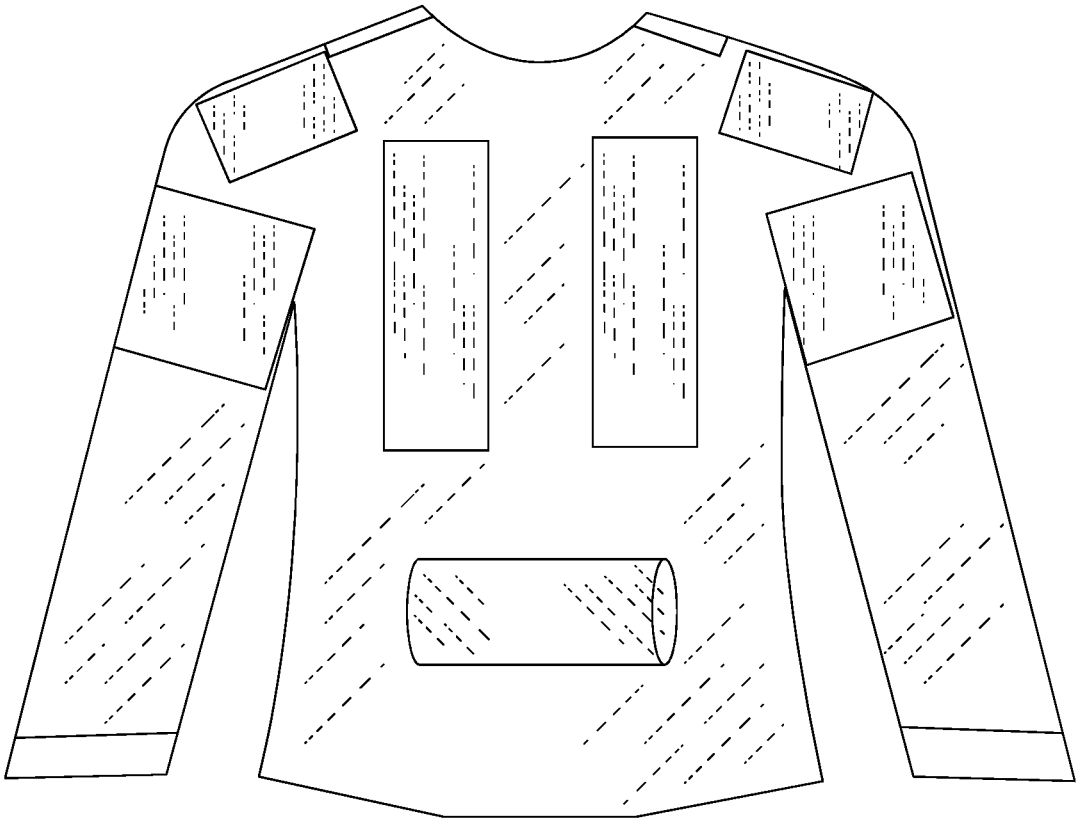
FIG. 11 is a rear view showing the overboard tracking device integrated into a PFD jacket.
Figure 12:
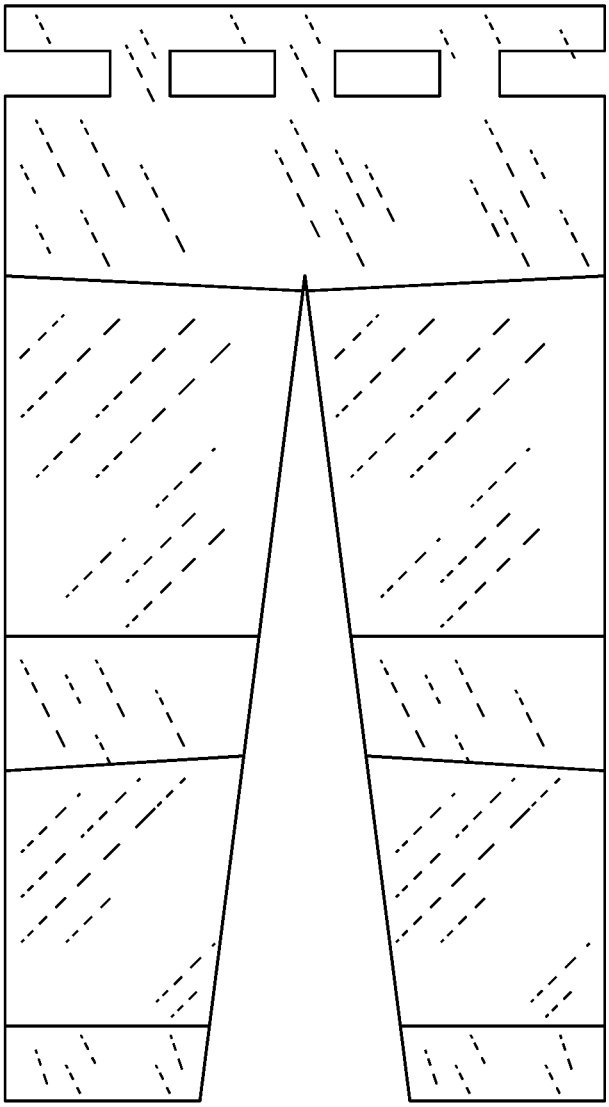
FIG. 12 is a front view showing the overboard tracking device integrated into PFD pants.

In further embodiments, the present invention can be integrated on PFDs or in the body of a garment. As can be seen in FIGS. 7 and 8, the present invention can be integrated on a PFD, such as a life vest. The PFD can be structured with a plurality of layers comprising an outer layer, an antenna layer, a power-storage layer, a thermionic layer, a flotation layer, and a thermal layer. The thermal layer can be an activatable heat mechanism comprising a plurality of chemical substances that initially are separately provided. The activatable heat mechanism can be engaged to mix the plurality of chemical substances to cause an exothermic reaction. The flotation layer may comprise a plurality of flotation devices which maintain the user afloat in a body of water. The thermionic layer generates power from the temperature differential between the thermionic layer and its surroundings. The power-storage layer is electrically connected to the thermionic layer to store the power generated from the thermionic layer. The antenna layer may comprise an antenna and a processor to transmit radio signals to help track the user using search radars. The outer layer comprises a plurality of NIR stripes and a plurality of retro-reflective materials for daytime and nighttime visibility.

The PFD with the present invention integrated on may further comprise a plurality of survival gadgets. As can be seen in FIGS. 7 and 8, the plurality of survival gadgets may comprise a mobile device hub, at least one survival kit, and a pyrotechnics kit. The mobile device hub may comprise a storage compartment to receive at least one mobile device, a docket, a controller, and a plurality of body sensors. The docket is electronically connected to the controller to connect the mobile device to the controller. The docket may also wirelessly connect the mobile device to the controller utilizing short-distance radio technologies. The plurality of body sensors is distributed about the PFD to measure various body variables such as body temperature or blood pressure. The pyrotechnics kit can be a standard pyro kit which can be used to generate a pyro signal. The survival kit can include various tools such as first aid tools to help the user attend injuries. In addition, the PFD can further comprise a plurality of LED strobe lights and a plurality of NIR strobe lights which generate a visual signal to help locate the user wearing the PFD. To facilitate the operation of the plurality of strobe lights, a plurality of solar panels is further externally integrated into the body of the PFD to generate enough power to power up the plurality of strobe lights. The plurality of solar panels can also provide power to facilitate the operation of the electronic components of the present invention. Finally, the PFD may comprise a baton signal antenna and the balloon signal antenna to transmit higher radio frequencies. The baton signal antenna and the balloon signal antenna are each electronically connected to the antenna layer. Furthermore, the PFD garment can be designed for specific applications, such as military applications, in the form of multipiece garments. As can be seen in FIG. 9 through 12, the multipiece garment may comprise headgear, an upper-body portion, and a lower-body portion. The plurality of layers is integrated into the headgear as well as the plurality of strobe lights and plurality of solar panels. The upper-body portion may comprise a similar structure to the PFD garment. In further embodiments, the present invention can be structured to meet different requirements depending on the application of the PFD garment. The present invention can also be integrated on different objects which can be available to users in maritime applications.

The present invention may further comprise an overboard alarm system. The overboard alarm system may comprise a vessel transmitter and an alarm module. The vessel transmitter can be located on a vessel or a transportation vehicle to passively track the location of the user while the user is with the vessel. The alarm module is integrated into the present invention to generate an alarm signal once the user falls overboard. The alarm module may utilize a plurality of movement tracking devices, such as an accelerometer or gyroscope, which monitor the movement of the user. The plurality of movement tracking devices may generate the alarm signal once a preset threshold is met, such as immediate acceleration or change of elevation relative to the position of the vessel transmitter. The vessel transmitter is wirelessly connected to the alarm module so when the vessel transmitter receives the alarm signal from the alarm module, an overboard notification is generated. The overboard notification is transmitted to appropriate users through multiple communication channels. In further embodiments, the alarm module may communicate with third-party systems to transmit the alarm signal through third-party communication channels.

Although the invention has been explained in relation to its preferred embodiment, it is to be understood that many other possible modifications and variations can be made without departing from the spirit and scope of the invention as hereinafter claimed.

What is claimed is:

1. An overboard tracking device comprises:
- a prismatic buoyant housing;
- a power source;
- at least one switch;
- a controller;
- a transceiver;
- a thermionic layer;
- an antenna layer;
- a waterproof casing;
- the prismatic buoyant housing comprising a first base portion, a second base portion, and a lateral portion;
- the power source, the controller, and the transceiver being mounted within the prismatic buoyant housing;
- the thermionic layer being externally superimposed onto the prismatic buoyant housing;
- the antenna layer being superimposed onto the thermionic layer;
- the waterproof casing being superimposed onto the antenna layer;
- the at least one switch being hermetically integrated through the waterproof casing, the antenna layer, and the thermionic layer and into the lateral portion;
- the power source being electrically connected to the controller and the thermionic layer; and,
- the controller being electronically connected to the at least one switch and the transceiver.

2. The overboard tracking device as claimed in claim 1 comprises:
- at least one illumination device;
- a weight;
- the at least one illumination device being hermetically integrated through the waterproof casing, the antenna layer, and the thermionic layer and into the first base portion;
- the weight being mounted within the prismatic buoyant housing, adjacent to the second base portion; and,
- the at least one illumination device being electronically connected to the controller.

3. The overboard tracking device as claimed in claim 2 comprises:
- the at least one illumination device comprising a light emitting diode (LED) strobe light and a near infrared (NIR) strobe light; and,
- the LED strobe light and the NIR strobe light being positioned offset from each other across the first base portion.

4. The overboard tracking device as claimed in claim 1 comprises:

the at least one switch comprising a manual switch and a water-activated switch;

the manual switch being positioned adjacent to the first base portion; and, the water-activated switch being positioned adjacent to the second base portion.

5. The overboard tracking device as claimed in claim 1, wherein the antenna layer is configured to receive an RF frequency selected from the group consisting of 406 MHz, X-band, S-band, and combinations thereof.

6. The overboard tracking device as claimed in claim 1, wherein the antenna layer is configured to transmit an RF frequency selected from the group consisting of 406 MHz, X-band, S-band, and combinations thereof.

7. The overboard tracking device as claimed in claim 1 comprises:

the power source comprises a plurality of coin batteries;

the plurality of coin batteries being stacked upon each other; and, the plurality of coin batteries being positioned adjacent to the second base portion.

8. The overboard tracking device as claimed in claim 1 comprises:

a global positioning system (GPS) antenna;

a GPS module;

the GPS antenna being hermetically integrated through the waterproof casing, the antenna layer, and the thermionic layer and into the first base portion;

the GPS module being mounted within the prismatic buoyant housing;

the controller being electronically connected to the GPS module; and, the GPS module being electronically connected to the GPS antenna.

9. The overboard tracking device as claimed in claim 1 comprises:

an anchoring mechanism;

a tether;

the tether comprising a first end and a second end;

the anchoring mechanism being fixed to the first end; and, the second end being hermetically integrated through the waterproof casing, the antenna layer, and the thermionic layer and into the second base portion.

10. An overboard tracking device comprises:

a prismatic buoyant housing;

a power source;

at least one switch;

a controller;

a transceiver;

a thermionic layer;

an antenna layer;

a waterproof casing;

at least one illumination device;

a weight;

the prismatic buoyant housing comprising a first base portion, a second base portion, and a lateral portion;

the power source, the controller, and the transceiver being mounted within the prismatic buoyant housing;

the thermionic layer being externally superimposed onto the prismatic buoyant housing;

the antenna layer being superimposed onto the thermionic layer;

the waterproof casing being superimposed onto the antenna layer;

the at least one switch being hermetically integrated through the waterproof casing, the antenna layer, and the thermionic layer and into the lateral portion;

the power source being electrically connected to the controller and the thermionic layer;

the controller being electronically connected to the at least one switch and the transceiver;

the at least one illumination device being hermetically integrated through the waterproof casing, the antenna layer, and the thermionic layer and into the first base portion;

the weight being mounted within the prismatic buoyant housing, adjacent to the second base portion; and, the at least one illumination device being electronically connected to the controller.

11. The overboard tracking device as claimed in claim 10 comprises:

the at least one illumination device comprising a light emitting diode (LED) strobe light and a near infrared (NIR) strobe light;

the power source comprises a plurality of coin batteries;

the at least one switch comprising a manual switch and a water-activated switch;

the LED strobe light and the NIR strobe light being positioned offset from each other across the first base portion;

the manual switch being positioned adjacent to the first base portion;

the water-activated switch being positioned adjacent to the second base portion;

the plurality of coin batteries being stacked upon each other; and, the plurality of coin batteries being positioned adjacent to the second base portion.

12. The overboard tracking device as claimed in claim 10, wherein the antenna layer is configured to receive and transmit an RF frequency selected from the group consisting of 406 MHz, X-band, S-band, and combinations thereof.

13. The overboard tracking device as claimed in claim 10 comprises:

a global positioning system (GPS) antenna;

a GPS module;

an anchoring mechanism;

a tether;

the tether comprising a first end and a second end;

the GPS antenna being hermetically integrated through the waterproof casing, the antenna layer, and the thermionic layer and into the first base portion;

the GPS module being mounted within the prismatic buoyant housing;

the controller being electronically connected to the GPS module;

the GPS module being electronically connected to the GPS antenna;

the anchoring mechanism being fixed to the first end; and, the second end being hermetically integrated through the waterproof casing, the antenna layer, and the thermionic layer and into the second base portion.

14. An overboard tracking device comprises:

a prismatic buoyant housing;

a power source;

at least one switch;

a controller;

a transceiver;

a thermionic layer;

an antenna layer;

a waterproof casing;

at least one illumination device;

a weight;

the prismatic buoyant housing comprising a first base portion, a second base portion, and a lateral portion;

the power source, the controller, and the transceiver being mounted within the prismatic buoyant housing;

the thermionic layer being externally superimposed onto the prismatic buoyant housing;

the antenna layer being superimposed onto the thermionic layer;

the waterproof casing being superimposed onto the antenna layer;

the at least one switch being hermetically integrated through the waterproof casing, the antenna layer, and the thermionic layer and into the lateral portion;

the power source being electrically connected to the controller and the thermionic layer;

the controller being electronically connected to the at least one switch and the transceiver;

the at least one illumination device being hermetically integrated through the waterproof casing, the antenna layer, and the thermionic layer and into the first base portion;

the weight being mounted within the prismatic buoyant housing, adjacent to the second base portion;

the at least one illumination device being electronically connected to the controller; and, the antenna layer is configured to receive and transmit an RF frequency selected from the group consisting of 406 MHz, X-band, S-band, and combinations thereof.

15. The overboard tracking device as claimed in claim 14 comprises:

the at least one illumination device comprising a light emitting diode (LED) strobe light and a near infrared (NIR) strobe light;

the power source comprises a plurality of coin batteries;

the at least one switch comprising a manual switch and a water-activated switch;

the LED strobe light and the NIR strobe light being positioned offset from each other across the first base portion;

the manual switch being positioned adjacent to the first base portion;

the water-activated switch being positioned adjacent to the second base portion;

the plurality of coin batteries being stacked upon each other; and, the plurality of coin batteries being positioned adjacent to the second base portion.

16. The overboard tracking device as claimed in claim 14 comprises:

a global positioning system (GPS) antenna;

a GPS module;

an anchoring mechanism;

a tether;

the tether comprising a first end and a second end;

the GPS antenna being hermetically integrated through the waterproof casing, the antenna layer, and the thermionic layer and into the first base portion;

the GPS module being mounted within the prismatic buoyant housing;

the controller being electronically connected to the GPS module;

the GPS module being electronically connected to the GPS antenna;

the anchoring mechanism being fixed to the first end; and, the second end being hermetically integrated through the waterproof casing, the antenna layer, and the thermionic layer and into the second base portion.

* * * * *